US007856916B2

(12) United States Patent
Anderson

(10) Patent No.: US 7,856,916 B2
(45) Date of Patent: Dec. 28, 2010

(54) ISOLATION SYSTEMS, INERTIAL NAVIGATION SYSTEMS, AND RECOIL ARTILLERY SYSTEMS

(75) Inventor: Robert B. Anderson, Largo, FL (US)

(73) Assignee: Honeywell International Inc., Morristown, NJ (US)

( * ) Notice: Subject to any disclaimer, the term of this patent is extended or adjusted under 35 U.S.C. 154(b) by 346 days.

(21) Appl. No.: 12/173,568

(22) Filed: Jul. 15, 2008

(65) Prior Publication Data

US 2010/0011952 A1 Jan. 21, 2010

(51) Int. Cl.
*F41A 25/00* (2006.01)

(52) U.S. Cl. ..... 89/44.02; 89/43.01; 89/43.02; 89/1.35; 267/136; 248/200; 248/200.1; 248/205.1; 248/274.1; 248/900; 248/916

(58) Field of Classification Search ..... 89/44.02, 89/43.01, 43.02, 1.35; 267/136; 248/200, 248/200.1, 205.1, 274.1, 900, 916
See application file for complete search history.

(56) References Cited

U.S. PATENT DOCUMENTS

| | | | | |
|---|---|---|---|---|
| 2,376,835 | A * | 5/1945 | Trotter | 89/33.14 |
| 2,475,090 | A * | 7/1949 | Green et al. | 89/44.01 |
| 2,701,963 | A * | 2/1955 | Balleisen et al. | 73/167 |
| 4,105,177 | A | 8/1978 | Smith et al. | |
| 4,351,515 | A | 9/1982 | Yoshida | |
| 4,371,143 | A | 2/1983 | Ishida et al. | |
| 4,402,483 | A | 9/1983 | Kurabayashi et al. | |
| 5,595,430 | A | 1/1997 | Weyeneth | |
| 5,918,850 | A | 7/1999 | Domange et al. | |
| 5,953,303 | A | 9/1999 | Sugano et al. | |
| 5,956,314 | A | 9/1999 | Ishimatsu et al. | |
| 6,039,299 | A | 3/2000 | Ohnishi et al. | |
| 6,498,722 | B1 * | 12/2002 | Stolz et al. | 361/679.36 |
| 6,530,563 | B1 | 3/2003 | Miller et al. | |
| 6,822,858 | B2 | 11/2004 | Allgeyer et al. | |
| 6,862,177 | B2 | 3/2005 | Chou | |
| 7,246,785 | B2 | 7/2007 | Monson et al. | |
| 7,267,313 | B2 | 9/2007 | Krzoska et al. | |
| 7,448,306 | B2 * | 11/2008 | Shipman et al. | 89/37.05 |
| 2006/0144216 | A1 * | 7/2006 | Shipman et al. | 89/37.05 |
| 2010/0116584 | A1 * | 5/2010 | Sanetick et al. | 181/207 |

* cited by examiner

*Primary Examiner*—Troy Chambers
*Assistant Examiner*—Samir Abdosh
(74) *Attorney, Agent, or Firm*—Ingrassia Fisher & Lorenz PC

(57) ABSTRACT

Recoil artillery systems and isolation systems are provided. An isolation system is provided for mounting an inertial navigation system onto an artillery system having a barrel adapted to move along a longitudinal axis during a firing sequence. The system includes an inner cradle, an outer cradle, first and second elastomeric isolators, and a first single axis damper. The first elastomeric isolator is mounted between the inner and outer cradles. The second elastomeric isolator is mounted between the inner and outer cradles. The first single axis damper is aligned substantially parallel with the longitudinal axis and includes a first end and a second end, the first end is mounted to the first inner sidewall, and the second end is mounted to the first outer sidewall.

20 Claims, 5 Drawing Sheets

ISOLATION SYSTEMS, INERTIAL NAVIGATION SYSTEMS, AND RECOIL ARTILLERY SYSTEMS

TECHNICAL FIELD

The inventive subject matter generally relates to recoil artillery systems, and more particularly relates to isolation and inertial navigation systems that may be included in recoil artillery systems.

BACKGROUND

Inertial measurement units ("IMU") are used to track changes in velocity and acceleration of moving objects without the use of a pre-calibrated external reference. Typically, an IMU includes electronics devices, such as gyroscopes and accelerometers. The electronics devices sense real-time rotational and acceleration data that are compared to reference data stored in the IMU. The compared data is then used to calculate a current position of the moving object.

Because IMUs operate virtually independently from other devices after receiving the reference data, they have been considered for implementation onto towed artillery systems. Specifically, IMUs have been investigated as devices for improving targeting accuracy of guided projectiles fired from the artillery systems. However, several obstacles have been encountered. For example, one or more IMUs are typically included as part of an inertial sensor assembly ("ISA") that is mounted in a chassis along with additional electronics. The ISA, and hence, the IMU, comprise part of an inertial navigation system (INS), which may be coupled directly to a platform on the towed artillery system. When one or more rounds of projectiles are fired from a barrel of the system, the INS, and hence, the IMU, experience a very high shock (e.g., greater than 40 G). The very high shock may cause the electronics devices within the INS to decouple from the chassis and to have a significantly decreased useful life.

To improve the useful life of the electronics devices, elastomeric isolators have been included between the chassis and the platform. Although displacement of the ISA relative to the platform is decreased by the elastomeric dampers, the ISA may still experience an undesirable magnitude of acceleration in response to the very high shock. In particular, the ISA and the platform may resonate in phase to thereby amplify an acceleration input into the system. Additionally, in instances in which the barrel may undergo rapid firing sequences, positioning of the INS, and hence, the IMU, relative to the system platform may change between shots, and the elastomeric isolators may not be capable of minimizing the positional changes (i.e., improved repeatability). As a result, the positional changes may affect the operability and pointing accuracy of the INS.

Accordingly, it is desirable to have a damping system that improves a useful life of an IMU that can be used in conjunction with a towed artillery system gun. In addition, it is desirable to have a damping system that provides repeatability of the INS and hence, the IMU, relative to the gun. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Isolation systems and recoil artillery systems are provided.

In an embodiment, by way of example, only, an isolation system is provided for mounting an inertial navigation system onto an artillery system having a barrel, the barrel adapted to move along a longitudinal axis during a firing sequence. The system includes an inner cradle, an outer cradle, first and second elastomeric isolators, and a first single axis damper. The inner cradle has a base plate, a first inner sidewall, and a second inner sidewall. The base plate is adapted to receive the inertial navigation system thereon, the first inner sidewall and the second inner sidewall are positioned opposite from each other, and the base plate extends therebetween. The outer cradle surrounds the inner cradle and includes a platform, a first outer sidewall, and a second outer sidewall. The first outer sidewall and the second outer sidewall are positioned opposite from each other, and the platform extends therebetween. The first elastomeric isolator is mounted between the first inner sidewall and the first outer sidewall. The second elastomeric isolator is mounted between the first inner sidewall and the first outer sidewall. The first single axis damper is aligned substantially parallel with the longitudinal axis and includes a first end and a second end, the first end is mounted to the first inner sidewall, and the second end is mounted to the first outer sidewall.

In another embodiment, by way of example only, a recoil artillery system having a barrel adapted to move along a longitudinal axis during a firing sequence. The recoil artillery system includes an inertial navigation system, an inner cradle, an outer cradle, elastomeric isolators, and single axis dampers. The inner cradle has a base plate, a first inner sidewall, and a second inner sidewall. The base plate includes the inertial navigation system thereon, and the first inner sidewall and the second inner sidewall are positioned opposite from each other and include the base plate therebetween. The outer cradle surrounds the inner cradle and includes a platform, a first outer sidewall, and a second outer sidewall. The first outer sidewall and the second outer sidewall are positioned opposite from each other and include the platform therebetween. First and second elastomeric isolators are mounted between the first inner sidewall and the first outer sidewall, and a third and a fourth elastomeric isolators are mounted between the second inner sidewall and the second outer sidewall. A first single axis damper is aligned substantially parallel with the longitudinal axis and including a first end and a second end, where the first end is mounted to the first inner sidewall and the second end is mounted to the first outer sidewall. The second single axis damper includes a first end and a second end, the first end is mounted to the second inner sidewall, and the second end is mounted to the second outer sidewall.

In still another embodiment, by way of example only, another recoil artillery system is provided. The recoil artillery system includes a barrel adapted to travel along a longitudinal axis during a firing sequence, an inertial navigation system adapted to aim the barrel at a desired location, and an isolation damping system coupling the barrel and the inertial navigation system. The isolation damping system includes an inner cradle having a base plate, a first inner sidewall, and a second inner sidewall, the base plate including the inertial navigation system thereon, the first inner sidewall and the second inner sidewall positioned opposite from each other and including the base plate therebetween, an outer cradle surrounding the inner cradle and including a platform, a first outer sidewall, and a second outer sidewall, the first outer sidewall and the second outer sidewall positioned opposite from each other and including the platform therebetween, a first elastomeric isolator mounted between the first inner sidewall and the first outer sidewall, a second elastomeric isolator mounted between the first inner sidewall and the first outer sidewall, and a first single axis damper aligned substantially parallel with the longitudinal axis and including a first end and a second end, the first end mounted to the first inner sidewall, and the second end mounted to the first outer sidewall.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
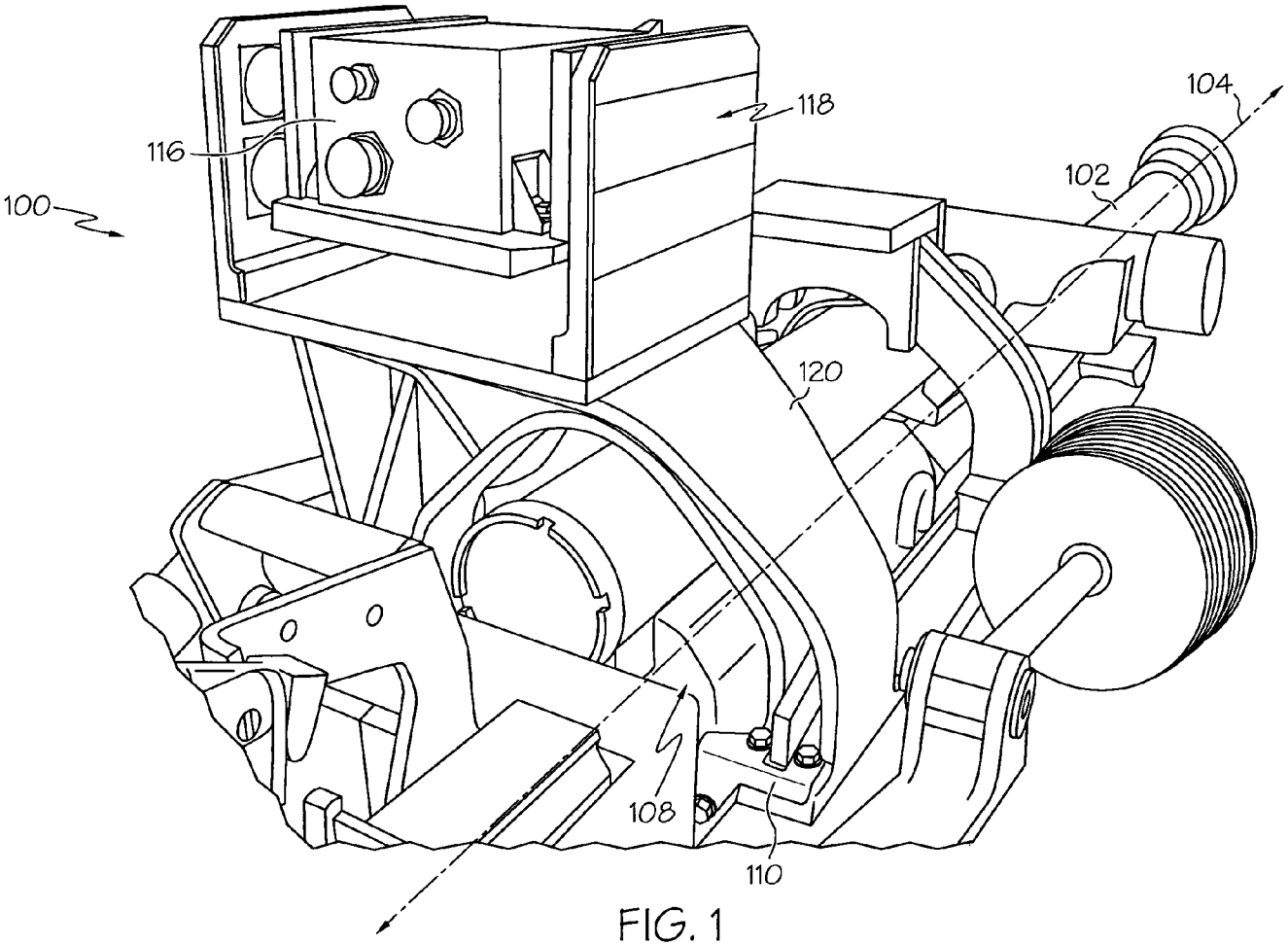
FIG. 1 is a perspective view of a portion of a recoil artillery system, according to an embodiment.

FIG. 1 is a perspective view of a portion of a recoil artillery system 100, according to an embodiment. The recoil artillery system 100 may be a towed artillery system that may be moved to a desired location and used to fire one or more projectiles at a desired target. In an embodiment, the recoil artillery system 100 may include a gun tube or barrel 102 adapted to travel along a longitudinal axis 104 during a firing sequence. The barrel 102 may be mounted to a movable base 108, which may be towed from location to location. In an embodiment, the movable base 108 may include a chassis 110 and an assembly for repositioning the chassis 110 relative to the desired target. For example, the assembly may include two or more wheels (not shown) rotatably attached to the chassis 110. In another example, the assembly may include a different feature suitable for repositioning the chassis 110, such a hover feature, or sliding mechanism. Moreover, although not shown, various damping elements, such as isolators, and bearing assemblies may be coupled between the chassis 110 and the barrel 102 to allow the barrel 102 to recoil during the firing sequence.

To precisely aim the barrel 102 at the desired target, the recoil artillery system 100 may also include an inertial navigation system (INS) 116 that is surrounded by an external isolation system 118. During and after the firing sequence, the INS 116 may have a tendency to move along the longitudinal axis 104. To minimize any acceleration and/or displacement that may be experienced by the INS 116 during the firing sequence, the external isolation system 118 is included. In an embodiment, the external isolation system 118 couples the INS 116 to the barrel 102 via a collar 120.

Figure 2:
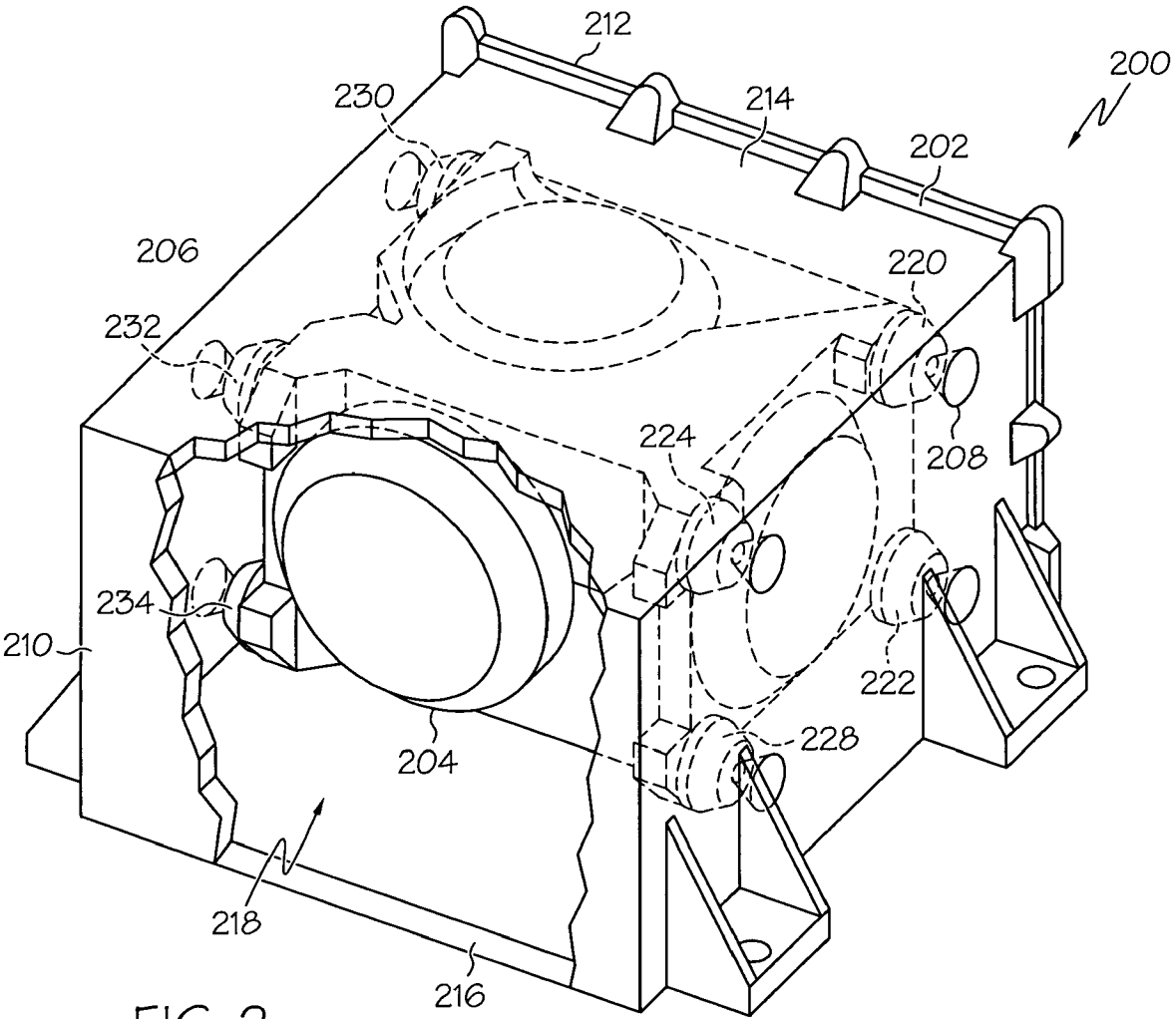
FIG. 2 is a perspective view of an interior portion of an inertial navigation system ("INS"), according to an embodiment.

FIG. 2 is a perspective view of an interior portion of an INS 200, according to an embodiment. The INS 200 includes a containment housing 202 and an inertial sensor assembly (ISA) 204 disposed in the containment housing 202. In accordance with an embodiment, the containment housing 202 includes sidewalls 206, 208, 210, 212 and end walls 214, 216 that together form a chamber 218. The containment housing 202 may have relatively small dimensions, such a width in a range of between about 20 cm to about 25 cm, a length in a range of between about 23 cm to about 27 cm, and a height in a range of between about 10 cm to about 15 cm. However, in other embodiments, the particular dimensions may be larger or smaller. Although the containment housing 202 is shown in FIG. 2 as being box-shaped, it may have any other shape suitable for disposal of ISA 204. For example, the containment housing 202 may be spherical, hemispherical, cube-shaped, or any other shape.

In any case, the ISA 204 may be positioned within the chamber 218 and may be made up of one or more inertial measurement units (not shown). In an embodiment, an inertial measurement unit for each axis of inertial motion may be included. Thus, for example, in an embodiment in which three axes each disposed orthogonally relative to each other are included, three inertial measurement units capable of measuring inertial motion along each axes may be included. The inertial sensor assembly 204 may be suspended between the sidewalls 206, 208, 210, 212 via one or more isolators 220, 222, 224, 228, 230, 232, 234. The one or more isolators 220, 222, 224, 228, 230, 232, 234 act as a primary isolation system to limit the vibration that may be transmitted through the containment housing 202 to the ISA 204. In an embodiment, one or more of the isolators 220, 222, 224, 228, 230, 232, 234 may be elastomeric isolators that include a cup-shaped elastomeric member having pads for mounting to mount surfaces (e.g., sidewalls 206, 208). Thus, the properties of the elastomeric isolators may be selected based on a natural frequency of the elastomeric member. For example, particular elastomeric materials, hardness of the elastomeric materials, and/or dimensions of the elastomeric isolator may be selected based on the desired natural frequencies. In one embodiment, the elastomeric material includes, but is not limited to natural rubber or silicone rubber. In another embodiment, the cup-shaped elastomeric material has an axial length in a range of between about 0.5 cm and about 1.0 cm and a widest diameter in a range of between about 2.0 cm to about 4.0 cm. In other embodiments, the dimensions are greater than or smaller than the aforementioned range. In still other embodiments, one or more of the isolators 220, 22, 224, 228, 230, 232, 234 may be other types of damping mechanisms, such as a viscous damper or wire rope isolator The isolators 220, 222, 224, 228, 230, 232, 234 may be positioned at particular locations within the chamber 218 to optimize isolation of vibration that may be experienced by the electronics 202. In one embodiment, as shown in FIG. 2, a first set of isolators (e.g., isolators 220, 222, 224, 228) extends between the ISA 204 and a first sidewall 206, while a second set of isolators (e.g., isolators 230, 232, 234) extends between the ISA 204 and a second sidewall 208. Although four isolators 220, 222, 224, 228 are included in the first set and three isolators 230, 232, 234 are included in the second set, fewer or more additional isolators may alternatively be included in one or both sets. Moreover, although two sets of isolators are shown disposed on sidewalls 206, 208, one or more isolators may alternatively or additionally extend between the ISA 204 and the other sidewalls 210, 212 or between the ISA 204 and the end walls 214, 216.

Figure 3:
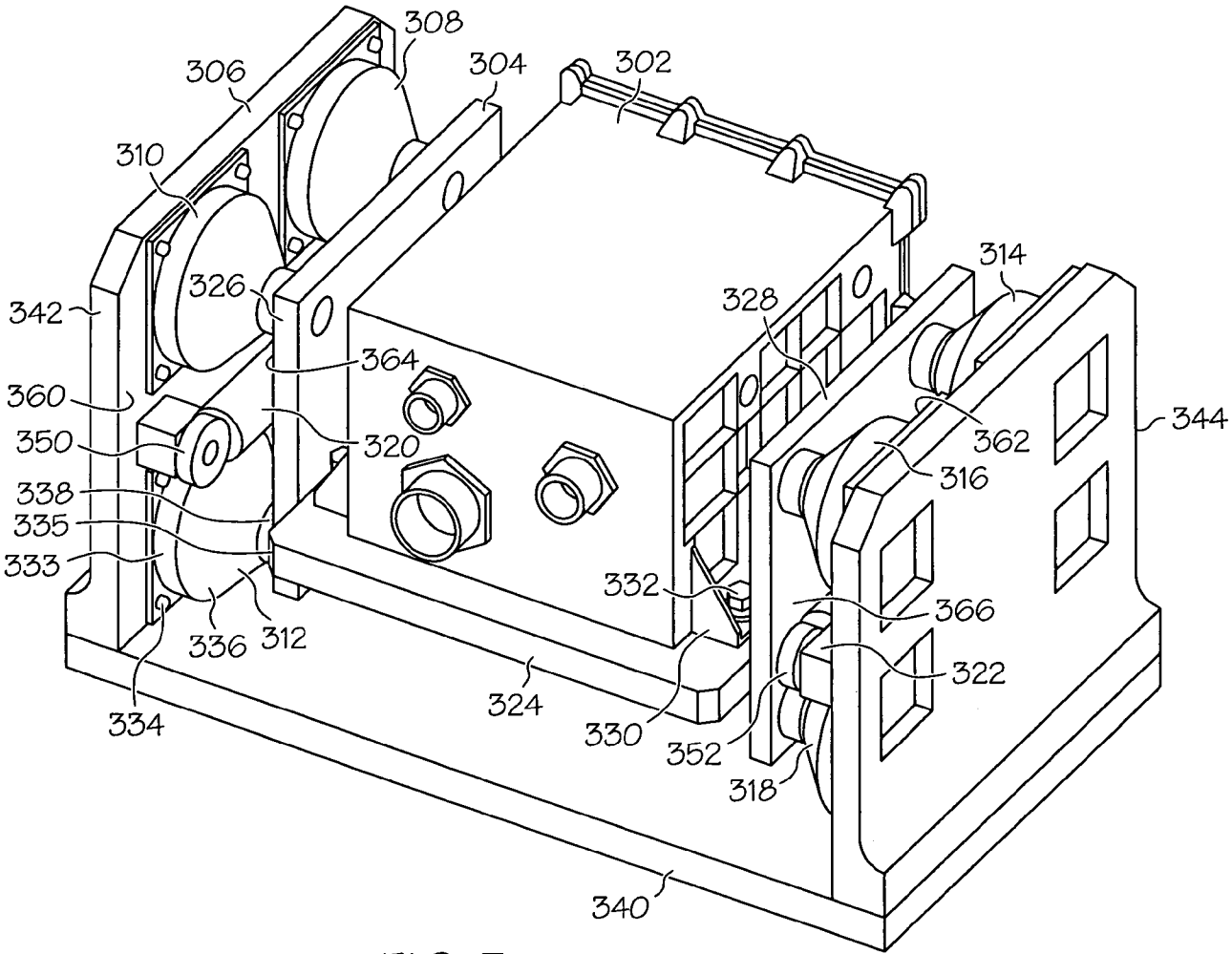
FIG. 3 is an isometric view of a secondary isolation system including an INS disposed therein, according to an embodiment.
Figure 4:
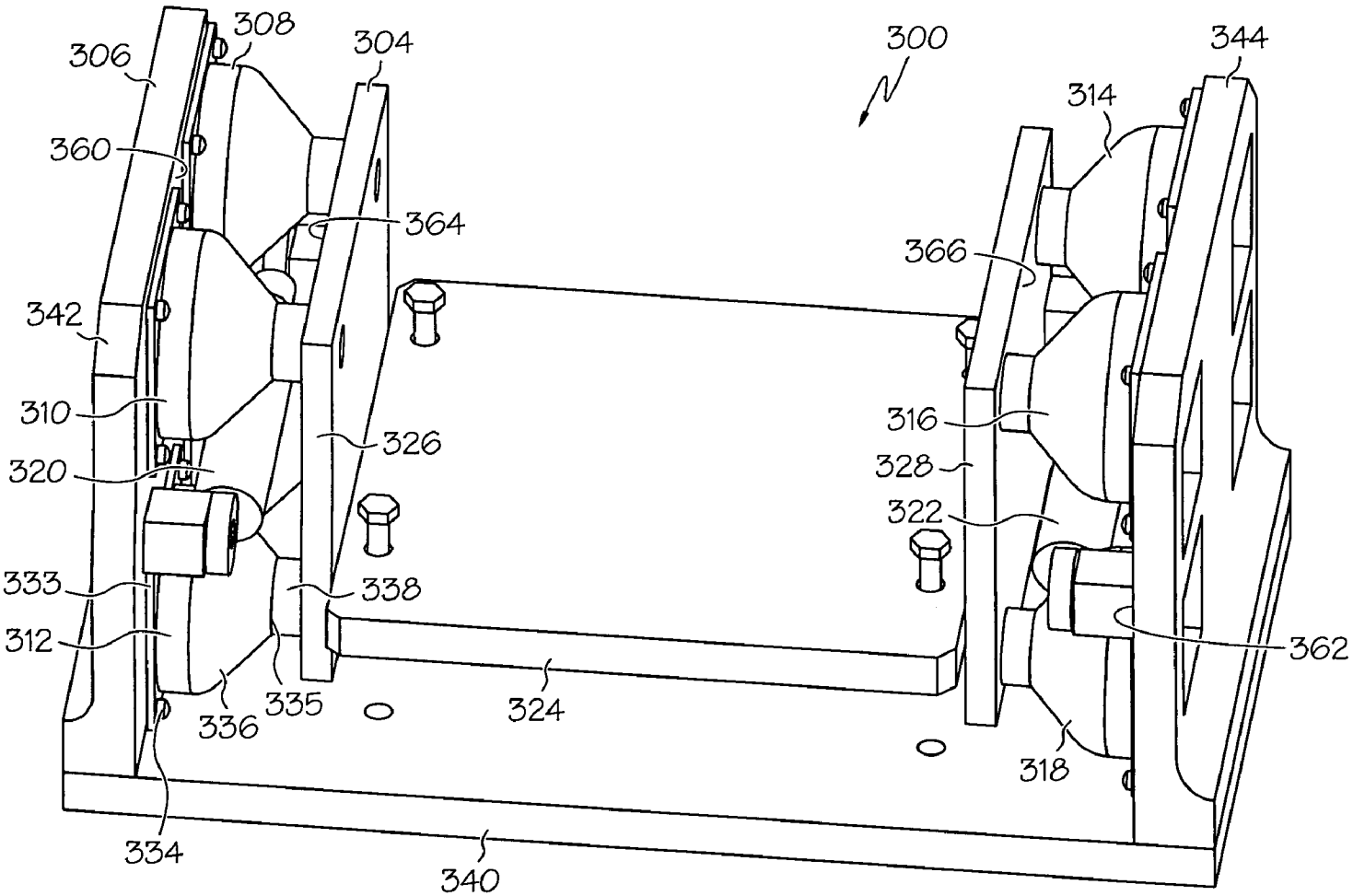
FIG. 4 is an isometric view of the secondary isolation system of FIG. 3 without the INS disposed therein, according to an embodiment.

To further reduce the acceleration experienced by the INS 200 during a firing sequence, the external isolation system 118 comprises a secondary isolation system. FIG. 3 is an isometric view of a secondary isolation system 300 including an INS 302 disposed therein, according to an embodiment, and FIG. 4 is an isometric view of the secondary isolation system 300 without the IMU disposed therein, according to an embodiment. The secondary isolation system 300 includes an inner cradle 304, an outer cradle 306, a plurality of elastomeric isolators 308, 310, 312, 314, 316, 318, and single axis dampers 320, 322, in an embodiment. According to an embodiment, the inner cradle 304 has a base plate 324, a first inner sidewall 326, and a second inner sidewall 328. The base plate 324 and the inner sidewalls 326, 328 may comprise a metallic material, such as aluminum, steel, or alloys thereof, a ceramic material, or any other material that is suitable for mounting the INS 302 thereto without interfering with the operability of the electronics (not shown).

The base plate 324 is adapted to receive the INS 302 thereon. In an embodiment, the base plate 324 has an area that is larger than a footprint of the INS 302. For example, the INS 302 may have a length in a range of between about 23 cm to about 27 cm and a width in a range of between about 20 cm to about 25 cm, while the base plate 324 may have a length in a range of between about 28 cm to about 30 cm and a width in a range of between about 28 cm to about 30 cm. In other examples, the dimensions of the INS 302 and the base plate 324 may be smaller or larger than the aforementioned ranges. In another example, the INS 302 may have dimensions that are smaller than the dimensions of the base plate 324. No matter the particular dimensions, the INS 302 may be attached to the base plate 324 via any fastener suitable for rigidly mounting the INS 302 to the base plate 324. For example, the INS 302 may include flanges 330 for bolts 332 or other fasteners to secure the INS 302 to the base plate 324.

The first and second inner sidewalls 326, 328 are positioned opposite from each other such that the base plate 324 extends therebetween, in an embodiment. In an example, the inner sidewalls 326, 328 are disposed substantially perpendicular to the base plate 324. Fasteners such as screws (not shown) can be used to secure the inner sidewalls 326, 328 to the base plate 324, in an embodiment. In other embodiments, the first and second inner sidewalls 326, 328 additionally or alternatively may be welded to the base plate 324, or the first and second inner sidewalls 326, 328 and base plate 324 may be integrally formed from a single piece of material. According to an embodiment, the first and second inner sidewalls 326, 328 are substantially equal in height. In another embodiment, the height of each of the first and second inner sidewalls 326, 328 are greater than that of the INS 302. For instance, the height of the first and second inner sidewalls 326, 328 may be in a range of between about 12 cm and about 17 cm, while the height of the INS 302 may be in a range of between about 10 cm and about 15 cm. It will be appreciated that in other embodiments, the heights of the inner sidewall 326, 328 and INS 302 may be greater or less than the aforementioned range. In yet other embodiments, the height of each of the first and second inner sidewalls 326, 328 may be less than the height of the INS 302.

The outer cradle 306 at least partially surrounds the inner cradle 304 and is adapted to cooperate with the elastomeric isolators 308, 310, 312, 314, 316, 318, and single axis dampers 320, 322 to externally damp vibration and acceleration that may be transmitted from the barrel 102 (FIG. 1) to the INS 302. In this regard, the outer cradle 306 includes a platform 340, a first outer sidewall 342, and a second outer sidewall 344, each of which may comprise a metallic material, such as aluminum, steel or alloys thereof, a ceramic material, or another material that is suitable for mounting the inner cradle 304 to the collar 120 (FIG. 1).

The platform 340 is dimensioned to accommodate the inner cradle 304 and the plurality of elastomeric isolators 308, 310, 312, 314, 316, 318, and single axis dampers 320, 322. In an example, the platform 340 may have a length in range of between about 20 cm to about 30 cm and a width in range of between about 40 cm to about 50 cm. In other embodiments, the length and width of the platform 340 may be greater or less than the aforementioned ranges.

The first and second outer sidewalls 342, 344 are disposed opposite from each other such that the platform 340 extends therebetween. In an embodiment, the outer sidewall 342, 344 may be disposed substantially perpendicular to the platform 340. In accordance with another embodiment, fasteners such as screws or bolts are used to secure the outer sidewalls 342, 344 to the platform 340. Additionally or alternatively, the first and second outer sidewalls 342, 344 may be welded to the platform 340, or the first and second outer sidewalls 342, 344 and platform 340 may be integrally formed from a single piece of material. In an embodiment, the first and second outer sidewalls 342, 344 are substantially equal in height and may be greater in height than the first and second inner sidewalls 326, 328. For instance, if the heights of the first and second inner sidewalls 326, 328 are in a range of between about 12 cm and about 17 cm, the heights of the first and second outer sidewalls 342, 344 may be in a range of between about 18 cm and about 22 cm. It will be appreciated that in other embodiments, the heights of the inner and outer sidewall 326, 328, 342, 344 may be greater or less than the aforementioned range. In yet other embodiments, the height of each of the first and second outer sidewalls 342, 344 may be less than the height of each of the first and second inner sidewalls 326, 328.

The elastomeric isolators 308, 310, 312, 314, 316, 318 are adapted to resonate with a particular frequency that limits vibration received through the outer cradle 306. In this regard, the elastomeric isolators 308, 310, 312, 314, 316, 318 are coupled between the inner cradle 304 and the outer cradle 306. In an embodiment, a first set of elastomeric isolators are mounted between the first inner sidewall 326 and the first outer sidewall 342, and a second set of elastomeric isolators are mounted between the second inner sidewall 328 and the second outer sidewall 344. In an example, the first and/or second sets of elastomeric isolators are arranged in a rectangular configuration and each set may include four elastomeric isolators. Only three elastomeric isolators are shown in FIG. 3 for each set (e.g., elastomeric isolators 308, 310, 312 and elastomeric isolators 314, 316, 318). In other embodiments, fewer or more elastomeric isolators may be included. In still other embodiments, the arrangement of the sets of elastomeric isolators may not be rectangular, but instead may be a square, a circle, an oval, triangle or another shape. Moreover, although each set appears to be substantially identically configured, they may not be in other embodiments.

Each elastomeric isolator (e.g., elastomeric isolator 308, 310, 312, 314, 316, 318) may include an aluminum alloy attachment plate 334 and a conical elastomeric member 336 where a base end 333 thereof extends from an aperture through the attachment plate 334. The elastomeric member 336 may be molded and may be made of an elastomeric material that is selected to damp particular vibration frequencies. Suitable elastomeric materials include, but are not limited to, silicone, rubber, and the like. In another embodiment, the elastomeric member 336 may be otherwise formed with a metal insert 338 extending from a tip end 335 opposite the base end 333. Particular dimensions of the elastomeric member 336, such as the size, shape and other features of the member, may be tailored to isolate particular vibration frequencies as well. In an embodiment, for example, the elastomeric member 336 has a base end diameter of about 5.8 cm, a peak end diameter of about 2.0 cm, and a height of about 2.5 cm.

In an embodiment, each attachment plate 334 is coupled to an inwardly-facing surface 360, 362 of a corresponding outer sidewall (e.g., outer sidewall 342 or 344). The attachment plate 334 is secured to the outer sidewall by fasteners, such as screws, bolts, or other fastening means. The tip end 335 is secured to an outwardly-facing surface 364, 366 of a corresponding inner sidewall (e.g., inner sidewall 326 or 328) by fasteners, such as screws or bolts, which extend through the corresponding inner sidewall and into the metal insert 338.

Figure 5:
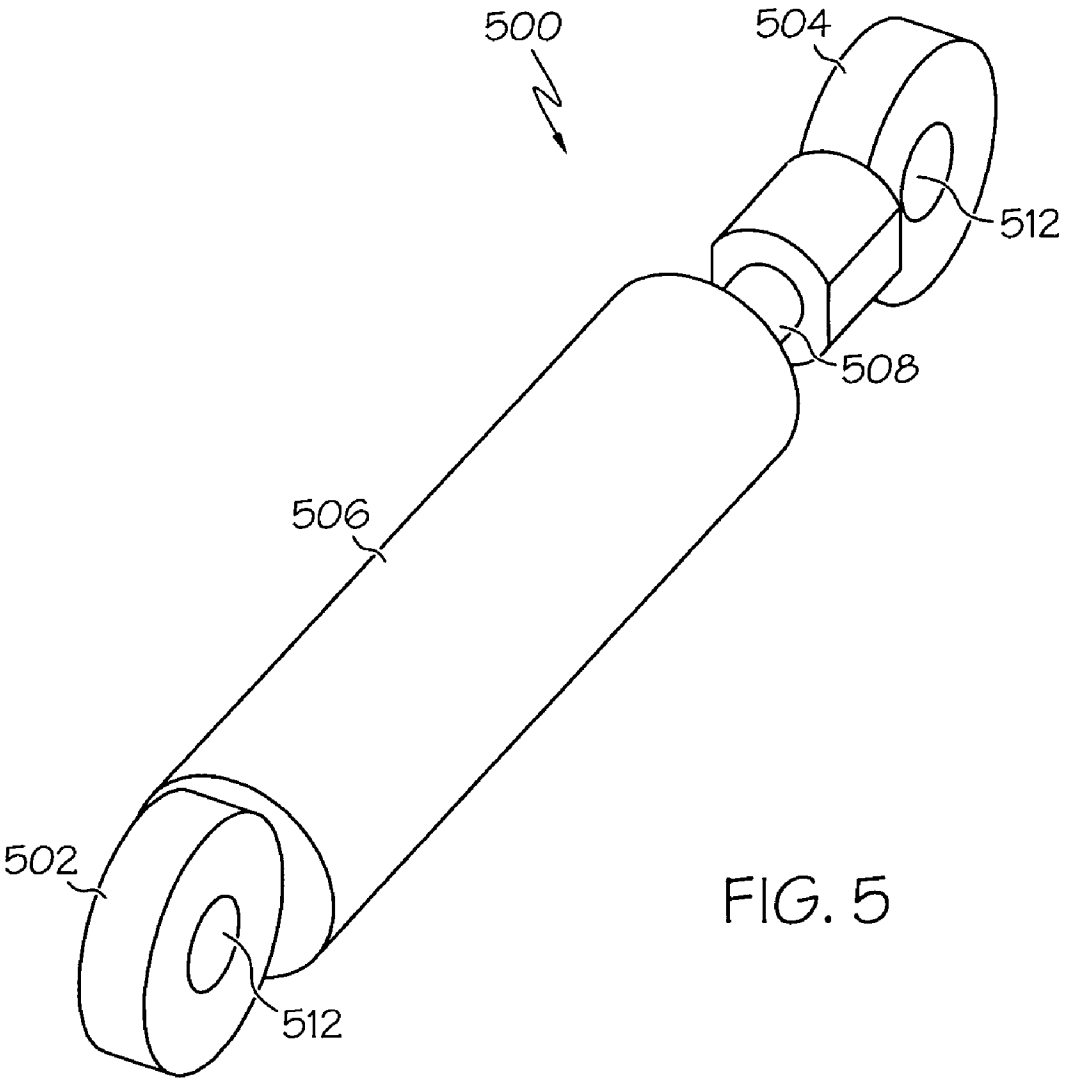
FIG. 5 is an isometric view of a shock absorber, according to an embodiment.

To decrease the acceleration that may be exerted on the INS 302, the single axis dampers 320, 322 are included between the inner and outer sidewalls 326, 328, 342, 344. In this regard, each single axis damper 320, 322 is aligned substantially parallel (e.g., ±10°) with the longitudinal axis 104 (FIG. 1) and thus, are substantially parallel to each other. In an embodiment, one or both of the single axis dampers 320, 322 may be shock absorbers. FIG. 5 is an isometric view of a shock absorber 500, according to an embodiment. The shock absorber 500 includes a first attachment end 502 and a second attachment end 504. The first attachment end 502 may be formed on a cylindrical outer member 506 and the second attachment end 504 may be formed on a rod 508 adapted to move into and out of the cylindrical outer member 506. The cylindrical outer member 506 may include fluid, gases, or other materials. Although now shown, the rod 508 may have one or more pistons included thereon that are disposed within the cylindrical outer member 506 to compress or otherwise act against the fluid, gases or other materials within the cylindrical outer member 506. Each attachment end 502, 504 may include fastener openings 510, 512 for attaching the shock absorber 500 to attachment surfaces within the secondary isolation system 300. Other suitable single axis dampers include, but are not limited to shock absorbers, viscous dampers, dashpots.

Returning to FIGS. 3 and 4, in an embodiment, a first end 350, 352 of the single axis damper 320, 322 is mounted to a corresponding outer sidewall (e.g., outer sidewall 342 or 344) and a second end (not shown) is mounted to an opposing inner side wall (e.g., inner sidewall 326 or 328). Each end may be secured to the sidewalls 326, 328, 342, 344 by fasteners such as bolts, screws, and the like. In other embodiments, one or both of the first and second ends may be configured to pivot so that one or both may swivel to allow the INS (e.g., INS 116 of FIG. 1, INS 200 of FIG. 2, or INS 302 of FIG. 3) to rotate in the presence of an imbalance. Although the single axis dampers 320, 322 are shown as being oriented across a length of their corresponding outer side walls, the dampers 320, 322 may alternatively be oriented diagonally across the outer side walls or in another manner, as long as the single axis damper 320, 322 are aligned substantially parallel with the longitudinal axis 104 (FIG. 1) when mounted in the second isolation system 300. In other embodiments, the single axis damper 320, 322 extend across an entire length of its corresponding outer sidewall 342, 344. However, this may not be the case in all embodiments. For example, one or both of the single axis dampers 320, 322 may extend across only a portion of its corresponding outer sidewall 342, 344.

As shown in FIG. 3, each single axis damper 320, 322 may extend between two or more elastomeric isolators 308, 310, 312, 314, 316, 318. In an embodiment in which the elastomeric isolators are in a rectangular configuration, two elastomeric isolators (e.g., elastomeric isolators 308, 310) may be disposed on one side of a single axis damper (e.g., damper 320), and another two elastomeric isolators (e.g., elastomeric isolator 312 and adjacent elastomeric isolator not shown) may be disposed on another side of the single axis damper. In other embodiments, more or fewer elastomeric isolators may be disposed on either side of the single axis damper. For instance, in some embodiments, all of the elastomeric isolators may be included on a single side of the single axis damper. Moreover, although two single axis dampers 320, 322 are shown in the embodiments depicted in FIGS. 3 and 4, more may alternatively be included.

By including the elastomeric isolators 308, 310, 312, 314, 316, 318 as part of a secondary isolation system in the manner described above, external isolation of the INS and inertial measurement units ("IMU") is provided. In this way, vibration that may be transmitted from the barrel 102 to the outer cradle of the secondary isolation system may be damped, and may minimally affect the inner cradle, and hence, the INS. By pairing the use of elastomeric isolators 308, 310, 312, 314, 316, 318 with the single axis dampers 320, 322 and by aligning the single axis dampers 320, 322 parallel with the longitudinal axis along which the barrel travels during a firing sequence, acceleration of the INS during the firing sequence is minimized. As a result, the INS may freely deflect and the single axis dampers allow for a slowed change in velocity to ultimately lower the acceleration. Consequently, the electronics within the INS and IMU may have longer lives, relative to a configuration in which the single axis dampers are not included. Additionally, the recoil artillery system may have improved repeatability, because the INS may reposition itself more accurately from firing to firing.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. An isolation system for mounting an inertial navigation system onto an artillery system having a barrel, the barrel adapted to move along a longitudinal axis during a firing sequence, the isolation system comprising:

an inner cradle having a base plate, a first inner sidewall, and a second inner sidewall, the base plate adapted to receive the inertial navigation system thereon, the first inner sidewall and the second inner sidewall positioned opposite from each other, and the base plate extends therebetween;

an outer cradle surrounding the inner cradle and including a platform, a first outer sidewall, and a second outer sidewall, the first outer sidewall and the second outer sidewall positioned opposite from each other, and the platform extends therebetween;

a first elastomeric isolator mounted between the first inner sidewall and the first outer sidewall;

a second elastomeric isolator mounted between the first inner sidewall and the first outer sidewall; and a first single axis damper aligned substantially parallel with the longitudinal axis and including a first end and a second end, the first end mounted to the first inner sidewall and the second end mounted to the first outer sidewall.

2. The isolation system of claim 1, further comprising a collar coupled to the outer cradle, the collar adapted to mount the outer cradle to the barrel.

3. The isolation system of claim 1, wherein the first single axis damper is disposed between the first elastomeric isolator and the second elastomeric isolator.

4. The isolation system of claim 1, further comprising:

a third elastomeric isolator mounted between the first inner sidewall and the first outer sidewall and disposed adjacent the first elastomeric isolator; and a fourth elastomeric isolator mounted between the first inner sidewall and the first outer sidewall and disposed adjacent the second elastomeric isolator; and wherein the first single axis damper extends between the third elastomeric isolator and the fourth elastomeric isolator.

5. The isolation system of claim 4, further comprising:

a fifth elastomeric isolator mounted between the second inner sidewall and the second outer sidewall;

a sixth elastomeric isolator mounted between the second inner sidewall and the second outer sidewall; and a second single axis damper including a first end and a second end, the first end mounted to the second inner sidewall, and the second end mounted to the second outer sidewall.

6. The isolation system of claim 5, further comprising:

a seventh elastomeric isolator mounted between the second inner sidewall and the second outer sidewall and disposed adjacent the fifth elastomeric isolator; and an eighth elastomeric isolator mounted between the second inner sidewall and the second outer sidewall and disposed adjacent the sixth elastomeric isolator; and wherein the second single axis damper extends between the seventh elastomeric isolator and the eighth elastomeric isolator.

7. The isolation system of claim 1, further comprising:

a third elastomeric isolator mounted between the second inner sidewall and the second outer sidewall;

a fourth elastomeric isolator mounted between the second inner sidewall and the second outer sidewall; and a second single axis damper including a first end and a second end, the first end mounted to the second inner sidewall, and the second end mounted to the second outer sidewall.

8. The isolation system of claim 7, wherein the first single axis damper and the second single axis damper are substantially parallel with each other.

9. The isolation system of claim 1, wherein the first single axis damper comprises a shock absorber.

10. A recoil artillery system having a barrel adapted to move along a longitudinal axis during a firing sequence, the recoil artillery system comprising:

an inertial navigation system;

an inner cradle having a base plate, a first inner sidewall, and a second inner sidewall, the base plate including the inertial navigation system thereon, the first inner sidewall and the second inner sidewall positioned opposite from each other and including the base plate therebetween;

an outer cradle surrounding the inner cradle and including a platform, a first outer sidewall, and a second outer sidewall, the first outer sidewall and the second outer sidewall positioned opposite from each other and including the platform therebetween;

a first elastomeric isolator mounted between the first inner sidewall and the first outer sidewall;

a second elastomeric isolator mounted between the first inner sidewall and the first outer sidewall;

a third elastomeric isolator mounted between the second inner sidewall and the second outer sidewall;

a fourth elastomeric isolator mounted between the second inner sidewall and the second outer sidewall;

a first single axis damper aligned substantially parallel with the longitudinal axis and including a first end and a second end, the first end mounted to the first inner sidewall and the second end mounted to the first outer sidewall; and a second single axis damper including a first end and a second end, the first end mounted to the second inner sidewall and the second end mounted to the second outer sidewall.

11. The recoil artillery system of claim 10, further comprising a collar coupled to the outer cradle, the collar adapted to mount the outer cradle to the barrel.

12. The recoil artillery system of claim 10, wherein the first single axis damper is disposed between the first elastomeric isolator and the second elastomeric isolator and the second single axis damper is disposed between the third elastomeric isolator and the fourth elastomeric isolator.

13. The recoil artillery system of claim 10, wherein the first single axis damper and the second single axis damper are substantially parallel with each other.

14. The recoil artillery system of claim 10, wherein the first single axis damper and the second single axis damper comprise shock absorbers.

15. A recoil artillery system, comprising:

a barrel adapted to travel along a longitudinal axis during a firing sequence;

an inertial navigation system adapted to aim the barrel at a desired location; and an isolation damping system coupling the barrel and the inertial navigation system, the isolation damping system including:

an inner cradle having a base plate, a first inner sidewall, and a second inner sidewall, the base plate including the inertial navigation system thereon, the first inner sidewall and the second inner sidewall positioned opposite from each other and including the base plate therebetween, an outer cradle surrounding the inner cradle and including a platform, a first outer sidewall, and a second outer sidewall, the first outer sidewall and the second outer sidewall positioned opposite from each other and including the platform therebetween, a first elastomeric isolator mounted between the first inner sidewall and the first outer sidewall, a second elastomeric isolator mounted between the first inner sidewall and the first outer sidewall, and a first single axis damper aligned substantially parallel with the longitudinal axis and including a first end and a second end, the first end mounted to the first inner sidewall, and the second end mounted to the first outer sidewall.

16. The recoil artillery system of claim 15, further comprising a collar coupling the outer cradle to the barrel.

17. The recoil artillery system of claim 15, wherein the first single axis damper is disposed between the first elastomeric isolator and the second elastomeric isolator.

18. The recoil artillery system of claim 15, further comprising:

a third elastomeric isolator mounted between the first inner sidewall and the first outer sidewall and disposed adjacent the first elastomeric isolator; and a fourth elastomeric isolator mounted between the first inner sidewall and the first outer sidewall and disposed adjacent the second elastomeric isolator; and wherein the first single axis damper extends between the third elastomeric isolator and the fourth elastomeric isolator.

19. The recoil artillery system of claim 18, further comprising:

a fifth elastomeric isolator mounted between the second inner sidewall and the second outer sidewall;

a sixth elastomeric isolator mounted between the second inner sidewall and the second outer sidewall; and a seventh elastomeric isolator mounted between the second inner sidewall and the second outer sidewall and disposed adjacent the fifth elastomeric isolator;

an eighth elastomeric isolator mounted between the second inner sidewall and the second outer sidewall and disposed adjacent the sixth elastomeric isolator; and a second single axis damper including a first end and a second end, the first end mounted to the second inner sidewall and the second end mounted to the second outer sidewall extending between the seventh elastomeric isolator and the eighth elastomeric isolator.

20. The recoil artillery system of claim 15, further comprising:

a third elastomeric isolator mounted between the second inner sidewall and the second outer sidewall;

a fourth elastomeric isolator mounted between the second inner sidewall and the second outer sidewall; and a second single axis damper including a first end and a second end, the first end mounted to the second inner sidewall and the second end mounted to the second outer sidewall.

* * * * *